US005480126A

United States Patent [19]

Teasdale

[11] Patent Number: 5,480,126

[45] Date of Patent: Jan. 2, 1996

[54] FENCING CONSTRUCTION

[75] Inventor: André Teasdale, Montreal, Canada

[73] Assignee: Soniplastics Inc., Quebec, Canada

[21] Appl. No.: 216,408

[22] Filed: Mar. 23, 1994

[51] Int. Cl.[6] ..... E04H 17/14

[52] U.S. Cl. ..... 256/19; 256/24; 256/1

[58] Field of Search ..... 256/19, 59, 65–66, 256/24; 52/729, 728, 730.5, 730.4, 732.2; 403/339, 340

[56] References Cited

U.S. PATENT DOCUMENTS

| | | | |
|---|---|---|---|
| 3,305,221 | 2/1967 | Kling | 256/21 |
| 3,454,262 | 7/1969 | Romano | 256/19 |
| 4,007,919 | 2/1977 | Totten | 256/65 X |
| 4,038,802 | 8/1977 | Bajorek et al. | 256/65 X |
| 4,050,828 | 9/1977 | Noro | 403/201 |
| 4,188,019 | 2/1980 | Meredith | 256/24 |
| 4,272,060 | 6/1981 | Stafford | 256/24 |
| 4,346,892 | 8/1982 | Tornya | 256/65 |
| 4,722,514 | 2/1988 | Pettit | 256/19 X |
| 4,809,955 | 3/1989 | Veilleux | 256/19 X |
| 4,938,445 | 7/1990 | Medley | 248/300 |
| 5,056,283 | 10/1991 | Sapinski | 52/184 |
| 5,078,367 | 1/1992 | Simpson et al. | 256/24 |
| 5,161,783 | 11/1992 | German | 256/19 |
| 5,255,897 | 10/1993 | Pepper | 256/66 X |
| 5,326,187 | 7/1994 | St. Marie et al. | 403/205 X |

FOREIGN PATENT DOCUMENTS

| | | | |
|---|---|---|---|
| 2247901 | 3/1992 | United Kingdom | 256/24 |

*Primary Examiner*—Eric K. Nicholson
*Assistant Examiner*—Harry C. Kim
*Attorney, Agent, or Firm*—Michael D. Bednarek; Marks & Murase

[57] ABSTRACT

The fencing construction comprises a sleeve for covering an elongated beam. The sleeve has a pair of symmetric L-shaped parts provided with opposite male and female interlocking members longitudinally extending along free edges thereof for meshing in a locking engagement and holding the two parts together around the beam. It allows to either upgrade an existing fence or construct a new fence with low cost materials, such as wood, and transform at least parts thereof into a PVC-like fence for improving its service life.

12 Claims, 6 Drawing Sheets

FENCING CONSTRUCTION

FIELD OF THE INVENTION

The present invention relates to a fencing construction, more particularly to a fencing construction providing sleeves for covering the beams thereof and boards that can be mounted between the beams.

BACKGROUND OF THE INVENTION

Among the most commonly found fences are the wood fences. These wood fences have been widely used over the years in conventional fencing constructions, especially around houses or the like. However, the maintenance of wood fences is often a tedious task since the wood is usually painted and the peeling of paint is difficult to overcome. When painting the wood for maintenance, the stripping of all the boards, rails and beams is generally required in order to have a good looking and long lasting new layer of paint.

One alternative to painted wood fences is to replace the wood by treated wood, either by substituting the existing wood or by treating the existing wood with suitable chemicals. Treated wood is usually more durable than painted wood and requires less maintenance. Replacing the existing wood is however costly and implies that the previous fence be discarded. As for treating existing wood, it generally pollutes and contaminates surrounding soils, and may even sterilize them.

Another usual substitute for conventional wood fences is a PVC fence. It has the advantage of being maintenance free and very long lasting. It is however very costly and usually difficult to install by unskilled persons.

SUMMARY OF THE INVENTION

The object of the present invention is then to provide a fencing construction allowing to either upgrade an existing fence, or construct a new fence with low cost materials, such as wood, and installing sleeves for transforming at least parts thereof into a PVC-like fence to improve its service life.

More particularly, the object of the present invention is to provide a sleeve for covering an elongated beam in a fencing construction, the sleeve comprising:

a pair of substantially symmetric L-shaped parts provided with opposite male and female interlocking members longitudinally extending along free edges thereof for meshing in a locking engagement and holding the two parts together around the beam.

It is also an object of the present invention to provide a fencing construction comprising:

at least two substantially vertical elongated beams;

two first sleeves for covering the vertical beams, each sleeve comprising a pair of substantially symmetric L-shaped parts provided with opposite male and female interlocking members longitudinally extending along free edges thereof for meshing in a locking engagement and holding the two parts together around a corresponding vertical beam;

at least two substantially horizontal beams having ends connected to the vertical beams;

two second sleeves for covering the horizontal beams, each sleeve comprising a pair of substantially symmetric L-shaped parts provided with opposite male and female interlocking members longitudinally extending along free edges thereof for meshing in a locking engagement and holding the two parts together around a corresponding horizontal beam.

A non restrictive description of some preferred embodiments will now be given with reference to the appended drawings.

DESCRIPTION OF PREFERRED EMBODIMENTS

Figure 1A:
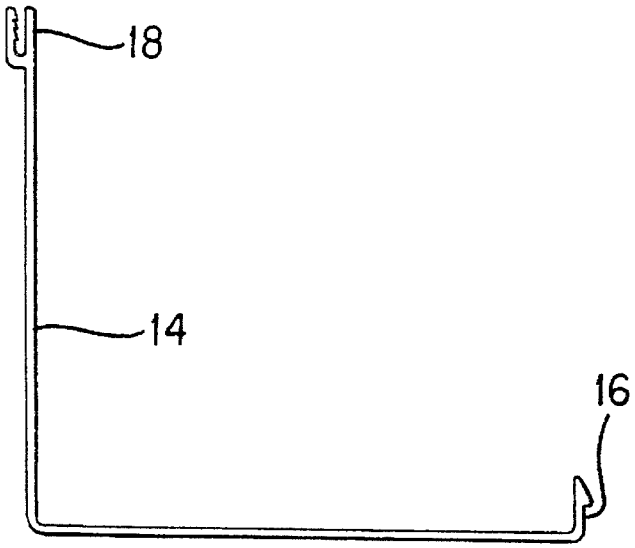
FIG. 1A is a side view of a part of a sleeve provided with one male and one female interlocking member according to an embodiment of the present invention.

Referring to FIGS. 1A to 4, there is shown an embodiment of one of the two parts of the sleeve 10 provided for covering an elongated beam 12 in a fencing construction. Each sleeve 10 comprises a pair of substantially symmetric L-shaped parts 14 provided with opposite male members 16 and female members 18 longitudinally extending along free edges of the parts 14 for meshing in a locking engagement with each other and holding the two parts 14 together around the beam 12. The locking engagement may be either a snuggle fit, a positive engagement or a combination thereof. The parts 14 are preferably made of a resilient but durable material like polyvinyl chloride (PVC) or any other polymer suitable for that purpose. As for the beam 12, it can be made of wood, metal, concrete or any other material suitable for the application.

Figure 1B:
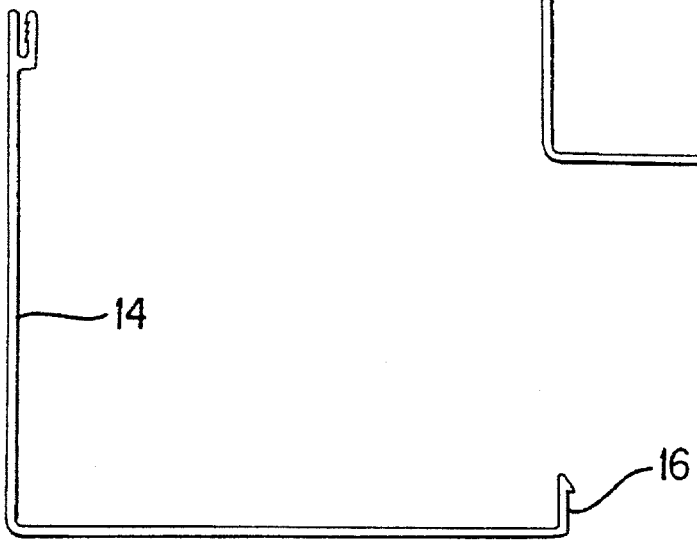
FIG. 1B is a side view of a part of a sleeve provided with one male and one female interlocking member according to another embodiment of the present invention.

As shown in FIGS. 1A and 1B, it is possible to have the male member 16 and female member 18 on the same part 14 for meshing with the other reversed part (not shown). Of course, it is also possible to have all male members 16 on one part and all female members 18 on the other part and still be able to join the two parts together.

Figure 2:
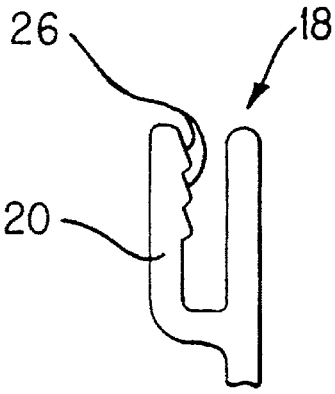
FIG. 2 is an enlarged side view of the female interlocking member of FIG. 1A.
Figure 3:
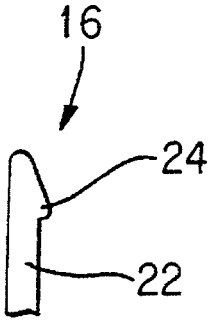
FIG. 3 is an enlarged side view of the male interlocking member of FIGS. 1A and 1B.

As shown in FIGS. 1A and 1B, and in the enlarged view of FIG. 2, each female member 18 is preferably a mortise defined between a L-shaped flange 20, laterally projecting from a free edge, and the free edge itself. As for the male member 16 shown in FIGS. 1A and 1B, and in the enlarged view of FIG. 3, each male member 16 is preferably a substantially flat flange 22 perpendicularly projecting from a free edge. Both pairs of male members 16 and female members 18 are shaped and sized for interlocking relationship. Additionally, the male member 16 may comprise at least one outer tooth 24 and the female member 18 may then comprise at least one inner tooth 26 for meshing with the tooth 24. This allows a very solid lock between the parts.

Figure 4:
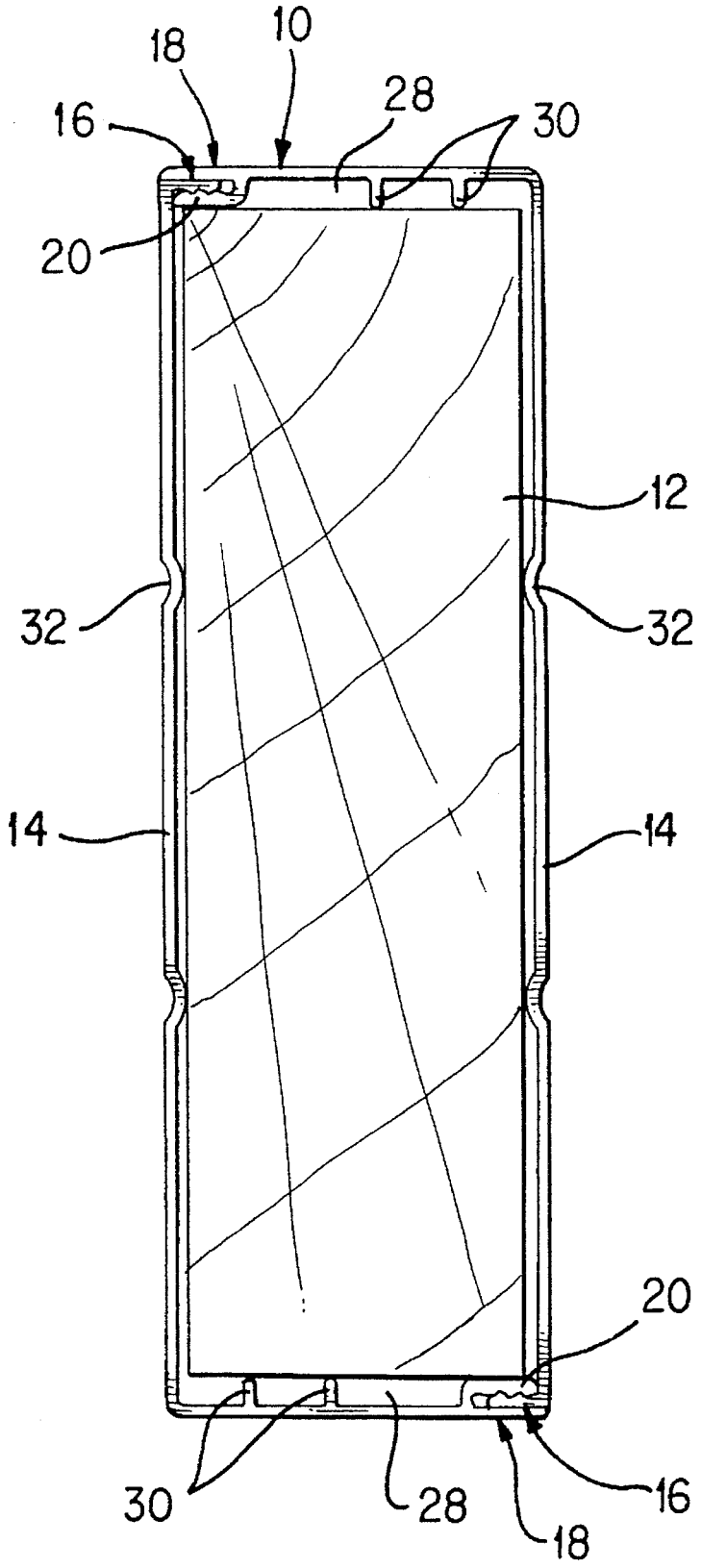
FIG. 4 is a side view of an assembled sleeve covering a beam and provided with protuberances and inner longitudinal flanges according to an embodiment of the present invention.
Figure 5:
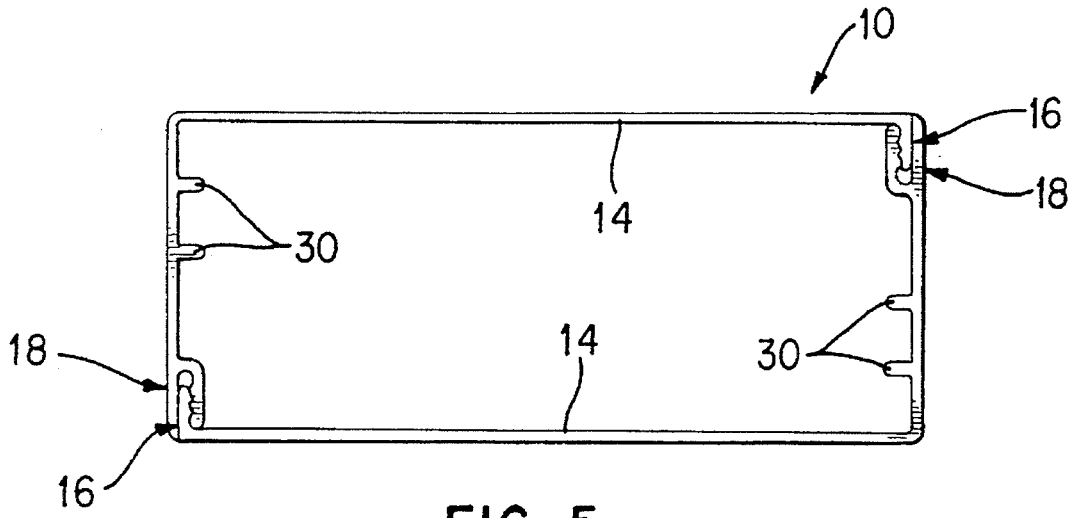
FIG. 5 is a side view of the assembled sleeve of FIG. 4 shown without the beam.

Referring to FIGS. 4 and 5, there is shown an example of a sleeve 10 covering a beam 12. In this embodiment, the L-shaped flange 20 of each of the two female members 18 laterally projects inside the sleeve 10 like in FIG. 1B. As it can be clearly seen in FIG. 4, this allows to create free spaces 28 at the top and at the bottom of the sleeve 10 when the beam 12 is installed. It further prevents the male members 16 and the female members 18 from being visible, thereby improving the appearance of the sleeve 10. The parts 14 may also further comprise a plurality of inner longitudinal flanges 30 perpendicularly protruding from a side of the parts 14 bearing the female members 18. The protruding flanges 30 preferably have a height substantially equal to the width of the female member 18 so that the sleeve 10 is properly spaced apart from the beam 12, even if some pressure is applied on top or bottom of the sleeve 10.

The spaces 28 allow some air to circulate and also to collect some of the moisture that may go inside.

In addition, a plurality of protuberances 32 projecting inside the sleeve 10 may be provided for spacing at the sides of the sleeve 10 from the beam 12 This again may allow some air to circulate around the beam 12.

Figure 14:
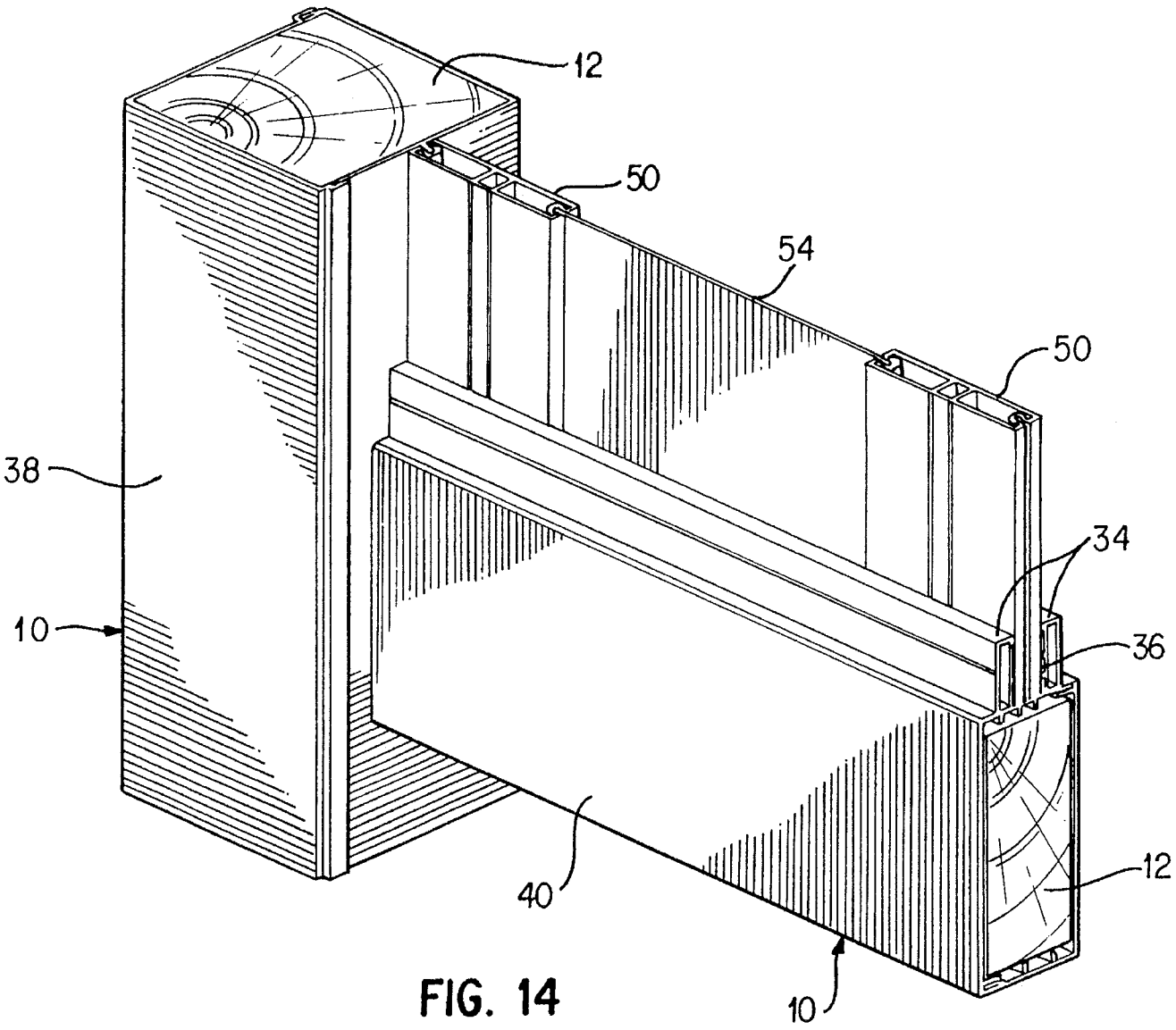
FIG. 14 is a partial perspective and cross-sectional view of the fencing construction of FIG. 9.

In some cases, particularly for vertical beams, it may be more suitable to have the L-shaped flange 20, each of the two female members 18 laterally projects outside the sleeve 10, thereby creating a square interior in the sleeve 10. Air circulation around vertical beams is generally less important since the moisture will almost inevitably go downwards. An example of such vertical beam is shown in FIG. 14.

Figure 6:
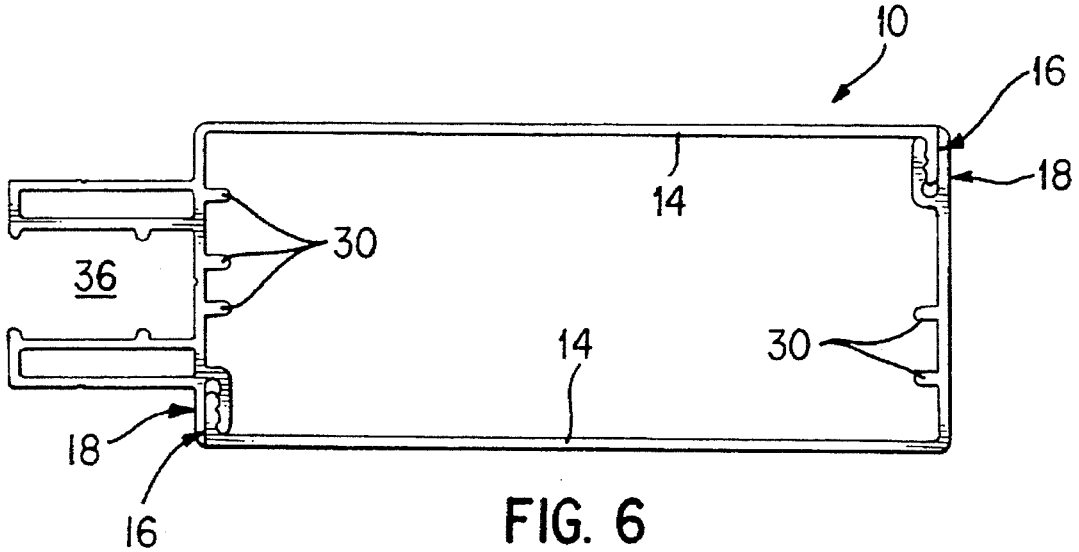
FIG. 6 is a side view of a sleeve similar to the one of FIG. 5 and further provided with a longitudinal channel on one side.
Figure 7:
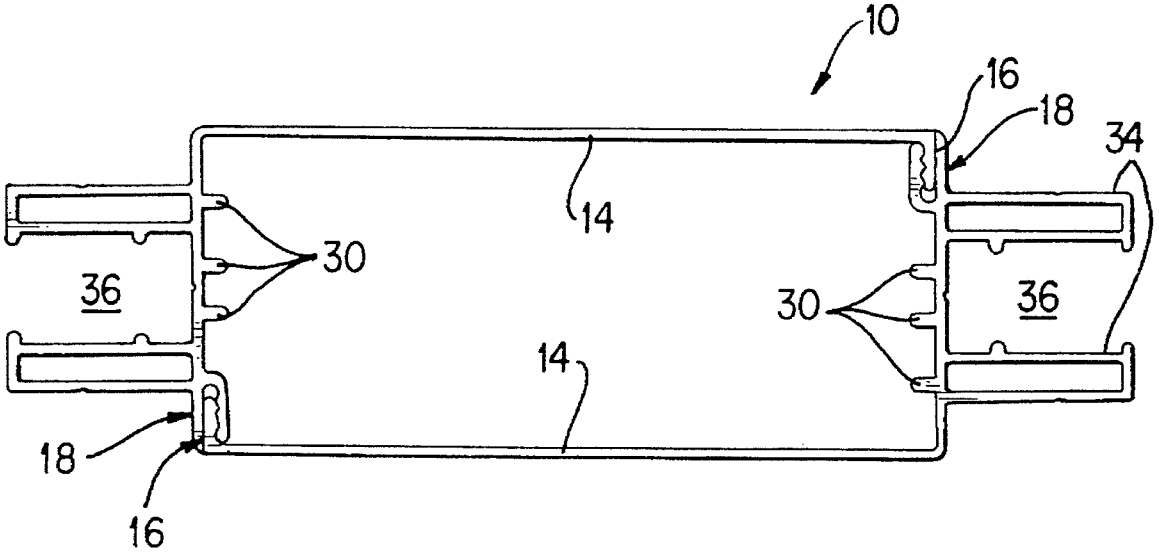
FIG. 7 is a side view of a sleeve similar to the one of FIG. 5 and further provided with a longitudinal channel on one side.

In a fence, there are usually vertical beams, also called posts, horizontal beams, also called rails, and vertical panels usually consisting of boards extending between two superposed rails. For holding the vertical panels, there is then provided a pair of parallel and longitudinal flanges 34 projecting outside one outer face of the sleeve 10 and defining a longitudinal channel 36 for holding vertical panels. FIG. 6 shows an example of a sleeve 10 with one channel 36, suitable for the top or bottom rail, and FIG. 7 shows an example of a sleeve 10 by dual channels 36, suitable for use as a middle rail if one is provided in the fencing construction. The sleeve 10 for FIG. 5 is suitable for covering the vertical panels.

Figure 8:
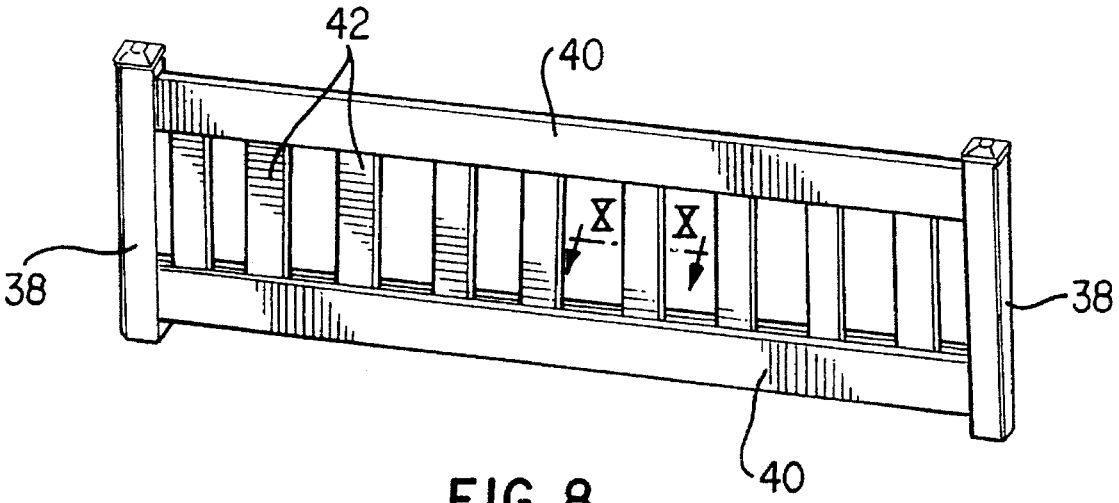
FIG. 8 is a perspective view of a fencing construction with spaced apart boards, according to an embodiment of the present invention.
Figure 12:
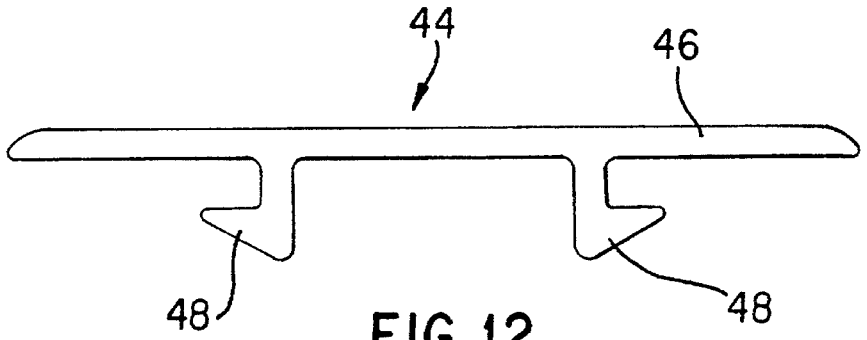
FIG. 12 is a side view of a cap.
Figure 13:
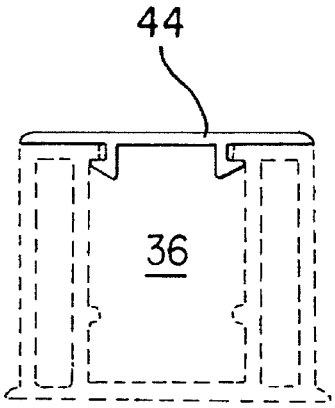
FIG. 13 is a side view of a cap mounted on a channel.

Referring to FIG. 8, there is shown a fencing construction having vertical beams 38, two horizontal beams 40 and vertical panels consisting of spaced apart elongated boards 42. The horizontal beams 40 have their ends connected to the vertical beams 38. In addition, a plurality of caps 44 may be provided for covering a space between the boards 42 in the channel 36 of the lowest of the second sleeves 10, thereby substantially preventing rain from entering the channel 36. As shown in FIG. 12, each cap 44 is preferably comprising a flat part 46 with two retaining members 48. FIG. 13 shows how the cap 44 fits on a channel 36.

Figure 9:
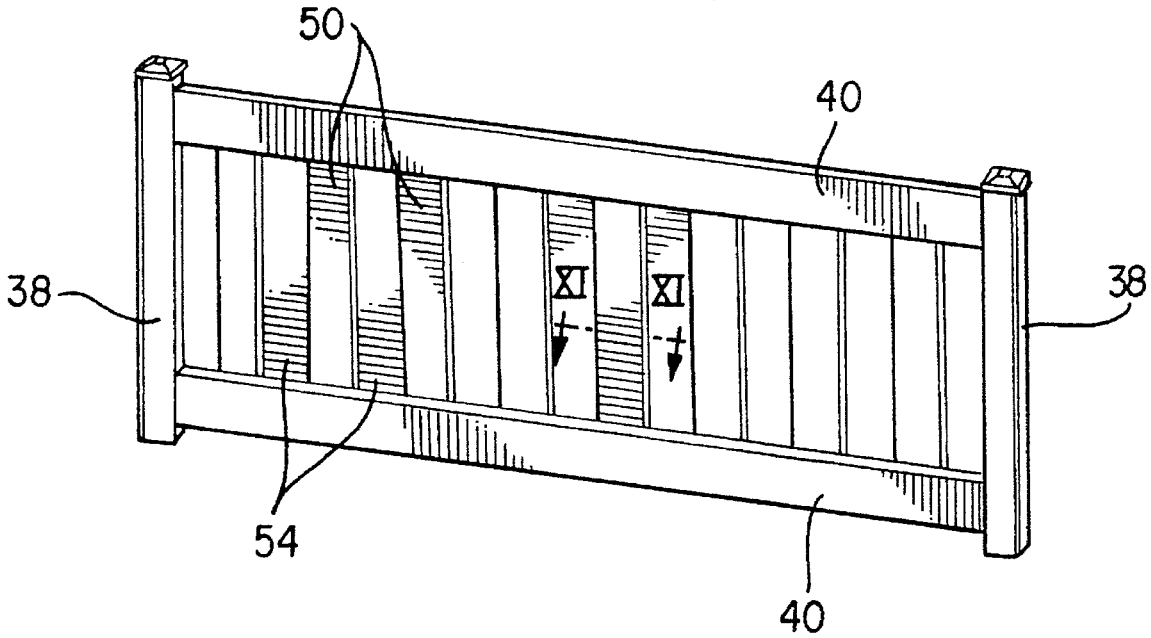
FIG. 9 is a perspective view of a fencing construction with boards and flat panels interposed between the boards.
Figure 10:
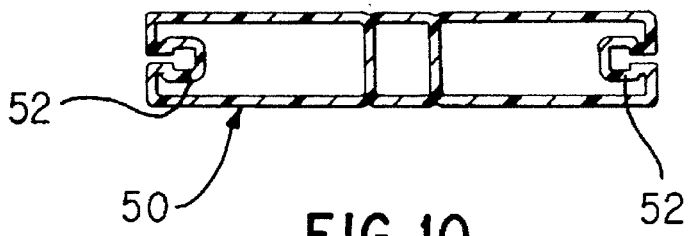
FIG. 10 is a cross-sectional view of a board according to line X—X in FIG. 8.
Figure 11:
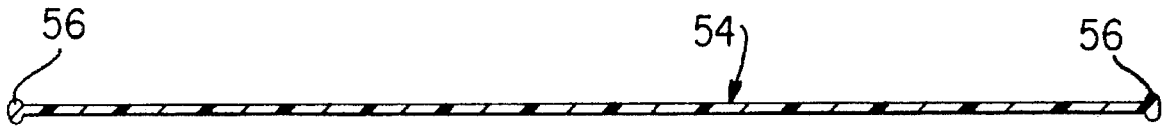
FIG. 11 is a cross-sectional view of a flat panel according to line XI—XI in FIG. 9.

Referring to FIG. 9, there is shown another embodiment of the fencing construction. In this embodiment, the vertical panels comprise elongated boards 50 provided with lateral grooves 52 extending vertical along its length and that can be made entirely of PVC. FIG. 10 shows the cross-section of a board 50. A flat panel 54 is then interposed between each pair of boards 50. Each panel 54 has lateral edges 56 meshable with the lateral grooves 52 of the boards 50 for defining a continuous resulting panel extending between the vertical beams 38. This embodiment is also shown in cross-section in FIG. 14.

The above-described invention is then very suitable for upgrading or replacing a conventional painted wood fence, or any other similar fences.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A sleeve for covering an elongated beam in a fencing construction, the sleeve comprising a pair of substantially symmetric L-shaped parts provided with opposite male and female interlocking members longitudinally extending along free edges thereof for meshing in a locking engagement and holding the two parts together around the beam, the male member being a substantially flat flange perpendicularly projecting from two free edges of the parts, the female member being a mortise comprising a L-shaped flange laterally projecting from two other free edges of the parts for receiving the corresponding male member in the locking engagement, the L-shaped flange of at least one of the female members laterally projecting inward, the parts further comprising a plurality of inner longitudinal flanges perpendicularly protruding from a side of the parts bearing one of the female members, the protruding flanges having a height substantially equal to the width of the female member.

2. A sleeve according to claim 1, wherein the L-shaped flange of the female member laterally projects outward.

3. A sleeve according to claim 1, wherein the male member comprises at least one outer tooth, the female member comprising at least one inner tooth for meshing with the tooth of the male member.

4. A sleeve according to claim 1, further comprising a plurality of protuberances projecting inside the sleeve for spacing at least one side of the sleeve from the beam.

5. A sleeve according to claim 1, further comprising a pair of parallel and longitudinal flanges projecting outside one outer face of the sleeve and defining a longitudinal channel for holding vertical panels extending between two beams, each covered with a sleeve.

6. A fencing construction comprising:

at least two substantially vertical elongated beams;

two first sleeves for covering the vertical beams, each sleeve comprising a pair of substantially symmetric L-shaped parts provided with opposite male and female interlocking members longitudinally extending along free edges thereof for meshing in a locking engagement and holding the two parts together around a corresponding vertical beam;

least two substantially horizontal beams having ends connected to the vertical beams;

two second sleeves for covering the horizontal beams, each sleeve comprising a pair of substantially symmetric L-shaped parts provided with opposite male and female interlocking members longitudinally extending along free edges thereof for meshing in a locking engagement and holding the two parts together around a corresponding horizontal beam.

7. A fencing construction according to claim 6, wherein each male member of the first and the second sleeves is a substantially flat flange each female member of the first and the second sleeves being a mortise for receiving the corresponding male member in the locking engagement.

8. A fencing construction according to claim 7, wherein the mortises of the female members of the first sleeves laterally project outwards, the mortises of the female members of the second sleeves laterally projecting inwards, the parts of the second sleeves further comprising a plurality of inner longitudinal flanges perpendicularly protruding from a side of the parts bearing one of the female members, the protruding flanges having a height substantially equal to the width of the female members of the second sleeves.

9. A fencing construction according to claim 6, further comprising two pairs of parallel and longitudinal flanges, each pair projecting outside one outer face of a corresponding second sleeve, and defining a longitudinal channel for holding vertical panels extending between the second sleeves.

10. A fencing construction according to claim 9, wherein the vertical panels consist of spaced apart elongated boards.

11. A fencing construction according to claim 10, further comprising a plurality of caps for covering a space between the boards in the channel of the lowest of the second sleeves.

12. A fencing construction according to claim 9, wherein the vertical panels comprise elongated boards provided with lateral grooves extending vertically along its length, a flat panel being interposed between each pair of boards, each panel having lateral edges meshable with the lateral grooves of the boards for defining a continuous resulting panel extending between the horizontal beams.

* * * * *